United States Patent [19]

Hearn et al.

[11] Patent Number: 4,899,320

[45] Date of Patent: Feb. 6, 1990

[54] DOWNHOLE TOOL FOR DETERMINING IN-SITU FORMATION STRESS ORIENTATION

[75] Inventors: David D. Hearn, Richardson; Eric S. Pasternack; Daniel J. Segalman, both of Plano, all of Tex.

[73] Assignee: Atlantic Richfield Company, Los Angeles, Calif.

[21] Appl. No.: 188,728

[22] Filed: Apr. 29, 1988

Related U.S. Application Data

[63] Continuation of Ser. No. 751,779, Jul. 5, 1985, abandoned.

[51] Int. Cl.[4] ..... G01V 1/00

[52] U.S. Cl. ..... 367/35; 181/105; 73/151

[58] Field of Search ..... 73/151, 784, 783

[56] References Cited

U.S. PATENT DOCUMENTS

| | | | |
|---|---|---|---|
| 2,927,459 | 3/1960 | Farrington | 367/35 |
| 4,149,409 | 4/1979 | Serata | 73/151 |
| 4,413,678 | 11/1983 | Gillespie | 166/179 |
| 4,524,433 | 6/1985 | Broding | 367/35 |

*Primary Examiner*—Thomas H. Tarcza
*Assistant Examiner*—Daniel T. Pihulic
*Attorney, Agent, or Firm*—Robert M. Betz

[57] ABSTRACT

A downhole tool carries an inflatable packer by means of which radial pressure may be applied to the surrounding formation. Transducers within the packer measure the radial direction and extent of formation displacements responsive to such pressure. In this way one can determine the directions of maximum and minimum horizontal in-situ formation stress.

8 Claims, 2 Drawing Sheets

DOWNHOLE TOOL FOR DETERMINING IN-SITU FORMATION STRESS ORIENTATION

This application is a continuation of application Ser. No. 06/751,779, filed July 5, 1985, abandoned.

BACKGROUND OF THE INVENTION

1. Field of the Invention

This invention is generally related to the field of well logging and more particularly to the use of downhole tools to determine the orientation of formation in-situ stresses.

2. Prior Art

Formations in the earth are characterized by stress fields which vary with depth and whose principal directions are vertical and horizontal. In the horizontal plane at any point, the horizontal stress field reaches a maximum in one direction and a minimum at right angles to the first direction. Information concerning these maximum and minimum horizontal stress directions is of substantial value in planning field exploitation both where hydraulic fracturing is to be employed for stimulation and where directional drilling is to be employed to exploit systems of natural fractures.

One prior art method for identifying formation in-situ stress orientation requires hydraulically fracturing the formation and deducing the orientation of such fracture through wellbore or surface measuring techniques. This is a prohibitively expensive method of collecting data. Another prior art method adapted to naturally fractured formations utilizes a downhole televiewer to view a fracture. This method only works if the wellbore intersects a natural fracture and is thus dependent for its success upon pure chance.

It is a general object of this invention to devise an improved method and apparatus for identifying formation in-situ stress orientation.

It is a more particular object of this invention to devise a downhole method and apparatus for the purpose indicated above which allows measurements to be taken at any number of depths during a single run.

It is a still further object of this invention to devise a downhole method and apparatus for the purpose indicated above which offers the economy and convenience of a wire line technique.

SUMMARY OF THE INVENTION

The method and apparatus of this invention utilizes a downhole tool which carries an inflatable packer. Means are provided for inflation of the packer against the borehole wall when the packer is positioned at a desired depth within a formation of interest. As the packer pushes against the surrounding formation the resulting radial displacements of such formation are measured along a plurality of paths directed outwardly from the axis of the borehole tool. This is preferrably accomplished by means of an array of transducers positioned within the packer so as to produce electrical outputs corresponding respectively to the radial components of displacement which such transducers measure.

So long as the formation material in the region of the borehole continues to respond in a linearly elastic manner these displacements will be proportional to the inflation pressure in the packer. However, the total stress field in the formation under these circumstances consists not only of the in-situ stress field but also the loading due to the packer. Once this loading causes the total stress field of the formation to pass beyond the linear range of the formation material, the in-situ stress orientation is reflected in borehole displacements preferentially in the direction of least in-situ stress. An orientation device carried by the borehole tool keyed to the individual transducer output identifies the directions of maximum and minimum formation displacements resulting from the packer pressure. These displacements correspond respectively to the directions of the minimum and maximum in-situ stress components.

Other objects and advanages of this invention in addition to those referenced above will become apparent from a consideration of the detailed description to follow taken in conjunction with the appended drawings.

DESCRIPTION OF THE PREFERRED EMBODIMENTS

Figure 1:
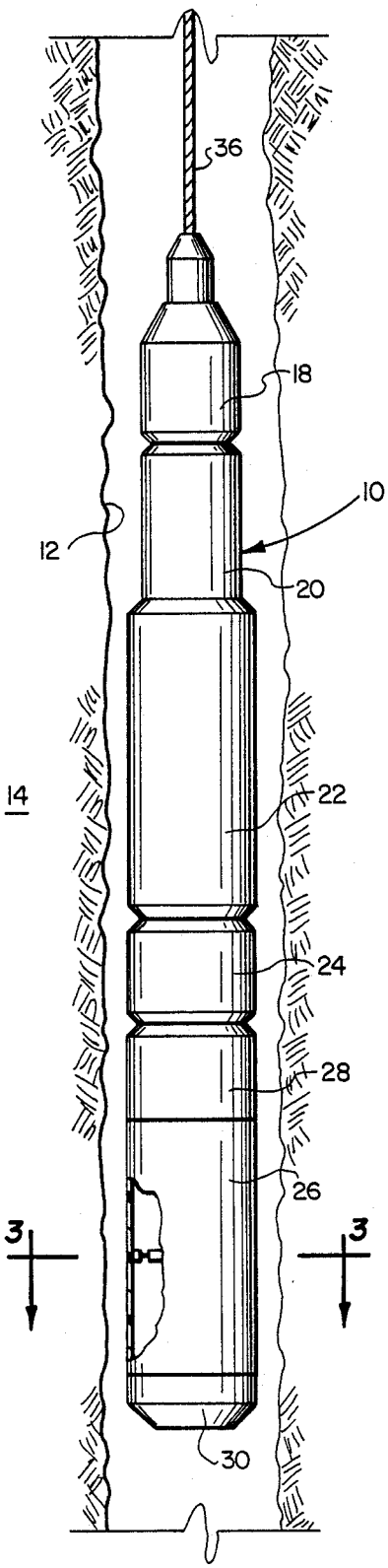
FIG. 1 is a vertical elevation of a borehole tool in accordance with the preferred embodiment of this invention shown as located within a formation of interest.
Figure 2:
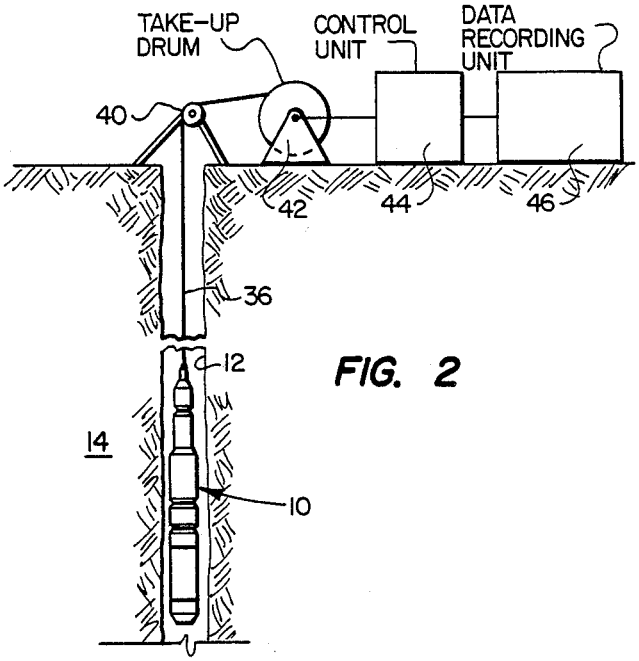
FIG. 2 is a diagrammatical view of the borehole tool of FIG. 1 illustrating connections to associated surface equipment.

With reference now to FIGS. 1 and 2 there is shown a borehole tool 10 situated in borehole 12 within formation 14. Proceeding in a downwardly direction borehole tool 10 comprises generally an orientation device 18, an electrical section 20 hydraulic reservoir 22, high pressure pump 24 and an inflatable packer 26 supported on a mandrel (not shown) extending between upper connector 28 and lower connector 30.

Borehole tool 10 may be lowered or raised within borehole 12 by means of wire line 36 supported at the surface by pulley 40 and take up drum 42. Related surface equipment includes a control unit 44 and data recording unit 46 both of which may be carried in a recording truck in a manner well-known in this art.

Figure 3:
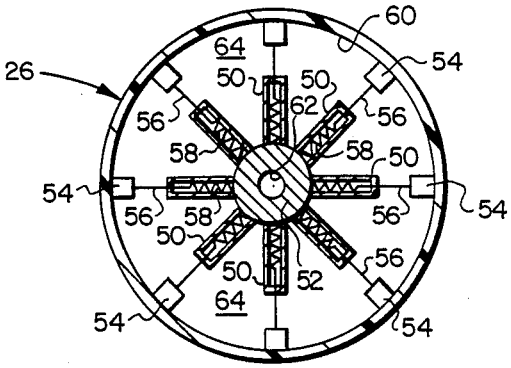
FIG. 3 is a section, partially diagrammatic, taken along line 3—3 in FIG. 1.

As best seen in FIG. 3, packer 26 contains an array of displacement transducers 50, such as, for example, the type known as linear variable displacement transducers or LVDT's, which extend radially from a hollow cylindrical mandrel 52 concentric with the longitudinal axis of tool 10. For the sake of illustration, but not by way of limitation, each transducer 50 is shown to comprise a pad 54 at its radial extremity interconnected by a rod 56 with a compression spring 58 which continuously urges pad 54 radially outward against the inner surface of wall 60 of packer 26. Transducer 50 may readily be designed so that they either retract radially or fold upwardly on hinges (not shown) during travel of tool 10 within borehole 12. Radial movement of pads 54 is converted through electrical signals which may be carried by means (not shown) through bore 62 of mandrel 52 into electrical section 20 of tool 10 for processing. It should be understood that transducers 50 adapted for use in this invention should have a sensitivity such that radial displacements of formation 14 on the order of one ten thousandth of an inch can be detected.

Figure 4:
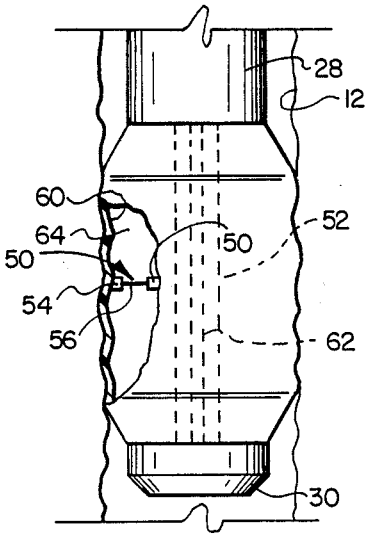
FIG. 4 is an enlarged detail of the packer of FIG. 1 in an inflated condition illustrating the manner in which the packer follows the irregularities of the wall of the borehole.

In operation borehole tool 10 is lowered in borehole 12 to a desired depth within formation 14. From control unit 44 pump 24 is energized and runs continuously with the aid of hydraulic reservoir 22. Responsive to the increased pressure of hydraulic fluid 64 therein packer 26 inflates so that it makes contact with the wall of borehole 12, as best seen in FIG. 4. In order for this invention to work properly the sidewall of the packer 26 must fit and conform precisely with any surface irregularities of the wall 60 of borehole 12 so that the readings of transducers 50 may be relied upon as accurate indicators of radial displacement of formation 14. Prior art impression packers meet this requirement.

Figure 5:
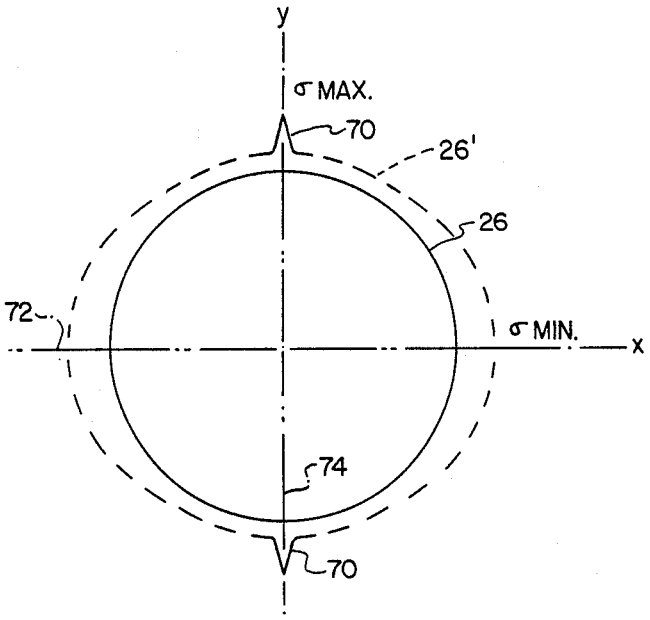
FIG. 5 is a diagrammatic illustration of the non-linear displacement of a formation responsive to packer pressure in accordance with this invention.

With reference now to FIG. 5, packer 26 may be initially considered to have a generally circular cross-section as shown in solid outline. As packer pressure increases and packer 26 inflates and makes contact with the wall 60 of borehole 12 an initial region of displacement of the formation 14 occurs which is linearly related to increase in packer pressure. However, it is theorized that the near wellbore region will be begin to fracture as soon as the pressure within packer 26 increases beyond what is to referred to in fracture technology as the "breakdown pressure". Beyond that point, displacements of formation 14 in the direction of the minimum in-situ stress component ($sigma_{min}$) will increase in a greater than linear manner. At the same time the displacement of formation 14 in the direction of the maximum in-situ stress ($sigma_{max}$) will increase in a less than linear manner. Shown in dotted line in FIG. 5 is moved position 26' of packer 26 corresponding to the above-described displacement behavior of formation 14. The incipient fracture zones 70 are presumed to appear along the direction of the maximum in-situ stress ($gamma_{max}$). Along the x-axis, in the direction of minimum in-situ stress, for a given packer pressure a transducer 50 aligned with the x-axis will measure some finite displacement 72. Another transducer 50 aligned with the y-axis, in the direction of maximum in-situ stress, will measure some smaller finite displacement 74.

Figure 6:
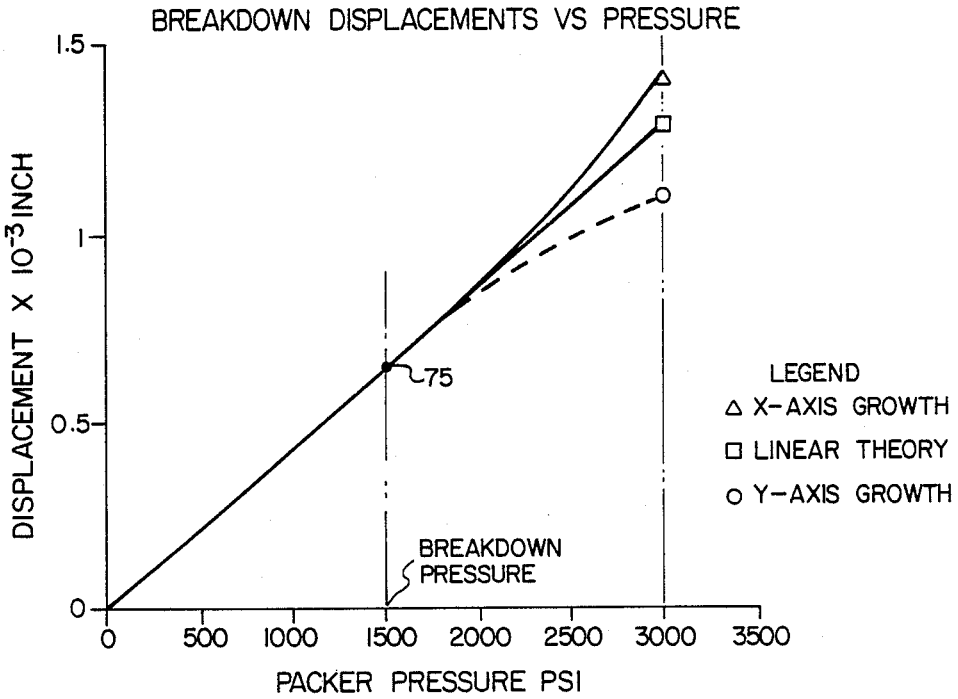
FIG. 6 is a graph illustrating the relationship between bottom hole pressure and formation displacement corresponding to the packer inflation shown in FIG. 5.

In order to further illustrate the theory of operation of borehole tool 10 a computer analysis of the operation of this invention has been plotted in FIG. 6. In this illustration it is assumed that borehole 12 is given a six inch diameter in a limestone formation. Hypothetical assumptions include a Young's modulus 8,000,000 psi and Poisson's ratio 0.17, a 1000 psi compressive stress acting in one horizontal direction (i.e. $sigma_{min}$), and a 1500 psi compressive stress acting in the other horizontal direction (i.e. $sigma_{max}$). It is further assumed that the length of packer 26 is large compared to the diameter of borehole 12. In this computer illustration a "plane strain" approximation is employed in a finite element calculation of radial displacement versus packer pressure. In FIG. 6 the calculated pressures of packer 26 and displacements of formation 14 are plotted selectively to show the displacement in the directions of minimum and maximum in-situ stress (these correspond respectively to the x and y axes in FIG. 5). In FIG. 6 in the region of packer pressure to approximately 1500 psi displacement along both x and y axes is linear. For pressures in excess of the breakdown pressure (point 75 on the graph) x-axis displacement increases most rapidly with increasing pressure and y-axis displacement increases least rapidly. For example, based on these results, at a packer pressure of 3000 psi, total x-direction formation displacement is approximately $1.875\times10^{-3}$ inches and y-axis displacement is approximately $1.225\times10^{-3}$ inches. Had the displacement in both directions been maintained in a linear relation to packer pressure, it would have been approximately $1.75\times10^{-3}$ inches.

In practice the data taken by means of transducers 50 may be amplified, conditioned and multiplexed or sampled by means of electrical section 20, the results being fed to data recording unit 46 and if desired passed to a computer graphics terminal (not shown) for presentation. With the aid of a standard orientation device 18 the actual heading of each transducer 50 may be continuously monitored, and the directions of maximum and minimum in-situ formation stress determined in the manner described can be assigned precise azimuthal directions. With the aid of wire line 36, tool 10 may be positioned successively at a series of different depths within formation 14 at which the above-described measurements may be repeated. In this way, the method and apparatus of this invention can be used in naturally fractured formations to identify in-situ stress orientations and thus the orientation of the natural fractures. A further area of potential use is in operations where fractures are to be induced. Also, the information so obtained may be used to select desirable orientations for directional drilling so as to maximized the chance of intersecting natural fractures. Spin off alternate uses of the method and apparatus described include orienting producing patterns so as to make maximum use of the drainage field associated with hydraulically fractured wells. Further, one may use a device of this character to determine the elastic properties of a formation and to evaluate and calibrate other logging tools designed to measure formation elastic properties.

Figure 7:
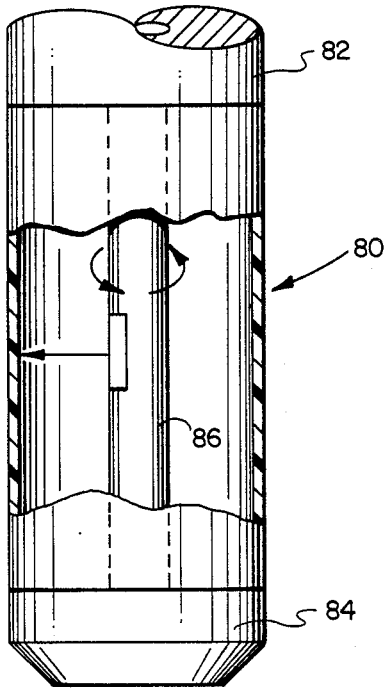
FIG. 7 is a detail of an inflatable packer in accordance with an alternate embodiment of this invention.

Within the scope of this invention, there is no intent to limit the means for measuring formation displacement to any particular type of transducer or measurement technique. For example, as shown in FIG. 7, an alternate embodiment of this invention utilizes an inflatable packer 80 and a borehole televiewer of well-known construction supported between upper and lower connectors 82 and 84. Borehole televiewer 86 is typically provided with rotatable electro-acoustical transducer means 88 which bounce acoustical pulses off the wall of packer 80 many times per revolution. The results can be sampled in much the same manner as described above in connection with the preferred embodiment in order to develop information concerning the directions of maximum and minimum formation displacement with expansion of packer 80.

The particular choice and arrangement of components of the apparatus of this invention are illustrative only and not intended to be limiting. Those skilled in the art will have no difficulty in devising modifications within the scope of this invention as more particularly set forth in the claims to follow.

What is claimed is:

1. A method of identifying the orientation of the horizontal in-situ stress field of a formation beneath an earth surface comprising the steps of:

(a) penetrating said formation with a downwardly-directed cylindrical borehole having a sidewall;

(b) exerting adjustable uniform radial pressure against substantially the entire circumference of said sidewall at a desired depth within said formation;

(c) measuring the displacement of said sidewall at said depth in each of a plurality of different radial directions with respect to the longitudinal axis of said borehole corresponding to successively greater values of said pressure;

(d) generating separate signals respectively representative of said displacements;

(e) associating each of said signals with the radial direction of the displacement which it represents;

(f) monitoring said signals in order to compare the relative magnitude of said signals, and (g) increasing said pressure until said comparison reveals a variation in said displacements from a maximum in at least one of said radial directions to a minimum in at least one other of said radial directions.

2. The method as claimed in claim 1 wherein said signals are monitored using a range of values of said pressure sufficient to establish a value of said pressure above which the relation between said displacements and said pressures becomes substantially non-linear in at least some of said radial directions.

3. An apparatus for determining the orientation of the horizontal in-situ stress field of a formation beneath an earth surface comprising:

(a) a tool body adapted to be positioned at a desired depth within a borehole extending downwardly into such formation and defined by a sidewall;

(b) means carried on said tool body for exerting adjustable uniform radial pressure against substantially the entire circumference of said sidewall at said depth;

(c) further means carried by said tool body for measuring the respective displacements of said sidewall at said depth in each of a plurality of different radial directions with respect to the longitudinal axis of said borehole corresponding to successively greater values of said pressure;

(d) means responsive to said measuring means for generating signals representative of said displacements;

(e) means for associating each of said signals with the radial direction of the displacement which it represents; and (f) means for comparing said signals in order to determine therefrom the relative magnitudes of said displacements, said pressure being increasable until a variation in said displacements from a maximum in at least one of said radial directions to a minimum in at least one other of said radial directions may be determined from a comparison of said signals.

4. Apparatus as claimed in claim 3 wherein said tool body further includes means for electrically sampling said signals.

5. The apparatus as in claim 3 wherein said means for exerting radial pressure against said sidewall comprises an inflatable packer encasing said tool body and means carried on said tool body for inflating said packer so as to exert said radial pressure.

6. An apparatus as in claim 3 further including means operatively connected to said measuring means for determining the compass heading of each of said radial directions.

7. An apparatus for determining the orientation of the horizontal in-situ stress field of a formation beneath an earth surface comprising:

(a) a cylindrical tool body adapted to be positioned at a desired depth within a borehole extending downwardly into such formation and defined by a sidewall;

(b) a mandrel carried on said tool body;

(c) an inflatable cylindrical packer affixed externally to said tool body in spaced-apart relation to said mandrel;

(d) means for adjustably inflating said packer so as to contact said sidewall and exert uniform radial pressure against substantially the entire circumference thereof; and (e) electromechanical transducer means positionable between said mandrel and said packer in a manner to generate electrical signals representative of the movement of said packer in each of a plurality of different radial directions at said depth with respect to the longitudinal axis of said borehole responsive to successive increasing values of said pressure; and (f) means for comparing said signals in order to determine therefrom the relative magnitudes of said displacements, said pressure increase being sustainable until a variation in said movement from a maximum in at least one of said radial directions to a minimum in at least one other of said radial directions is identifiable from a comparison of said signals.

8. The apparatus as claimed in claim 7 wherein said electromechanical transducer means comprise a plurality of separate linear variable displacement transducers each having a first end fixed to said mandrel and a second end opposite said first end adapted for resilient contact with said packer and for movement therewith responsive to said displacement in a respective one of said radial directions.

* * * * *